US009500989B2

(12) United States Patent
Shoji et al.

(10) Patent No.: US 9,500,989 B2
(45) Date of Patent: Nov. 22, 2016

(54) END SEAL MEMBER FOR ELECTROPHOTOGRAPHIC IMAGE-FORMING DEVICE

(75) Inventors: Susumu Shoji, Kobe (JP); Kazuro Fukui, Kobe (JP)

(73) Assignees: Susumu Shoji, Kobe-shi (JP); SANWA TECHNO CO., LTD., Kobe-shi (JP)

( * ) Notice: Subject to any disclaimer, the term of this patent is extended or adjusted under 35 U.S.C. 154(b) by 6 days.

(21) Appl. No.: 14/398,036

(22) PCT Filed: Apr. 30, 2012

(86) PCT No.: PCT/JP2012/061497

§ 371 (c)(1),
(2), (4) Date: Mar. 17, 2015

(87) PCT Pub. No.: WO2013/164871

PCT Pub. Date: Nov. 7, 2013

(65) Prior Publication Data

US 2016/0041501 A1 Feb. 11, 2016

(51) Int. Cl.

| | |
|---|---|
| ***G03G 15/08*** | (2006.01) |
| ***G03G 21/10*** | (2006.01) |
| ***G03G 15/00*** | (2006.01) |

(52) U.S. Cl.

CPC ..... *G03G 15/0886* (2013.01); *G03G 15/0817* (2013.01); *G03G 15/0881* (2013.01)

(58) Field of Classification Search

CPC ..... G03G 15/0817; G03G 15/0881; G03G 15/886

See application file for complete search history.

(56) References Cited

U.S. PATENT DOCUMENTS

2002/0141777 A1* 10/2002 Kamimura ..... G03G 15/0817 399/103
2013/0089355 A1* 4/2013 Nishida ..... G03G 21/0017 399/101

FOREIGN PATENT DOCUMENTS

| | | | |
|---|---|---|---|
| JP | 60-191056 | U | 12/1985 |
| JP | 02-210476 | A | 8/1990 |
| JP | 09-274380 | A | 10/1997 |
| JP | 11-194612 | A | 7/1999 |
| JP | 2000-170919 | A | 6/2000 |
| JP | 2003-107902 | A | 4/2003 |
| JP | 2007-179080 | A | 7/2007 |

* cited by examiner

*Primary Examiner* — Walter L Lindsay, Jr.
*Assistant Examiner* — Michael Harrison
(74) *Attorney, Agent, or Firm* — Westerman, Hattori, Daniels & Adrian, LLP

(57) ABSTRACT

A high-quality end seal member which is easy to manufacture, and which exhibits excellent sealing properties with respect to inhibiting the leakage of toner in a toner-handling device of an image-forming device. End seal member for inhibiting, at a desired acceleration, leakage of toner from end of rotating body using anti-leakage gap obtained by causing recessed region to be deformed toward rotating body is provided with sealing member having striped pattern comprising plurality of steps of linear configuration which come in contact with toner carrier, i.e. rotating body, of image-forming device. When toner conveyed by toner carrier comes in contact with radiused region at edge of projecting region of irregular surface of sealing member toner scraping angle is greater than toner angle of repose. Elastic body at back surface of sealing member is used to achieve reactive-force-providing elasticity for contact load between sealing member and rotating body.

7 Claims, 13 Drawing Sheets

Enlarged view of region A

Enlarged view of region A

END SEAL MEMBER FOR ELECTROPHOTOGRAPHIC IMAGE-FORMING DEVICE

TECHNICAL FIELD

The present invention relates to an end seal member used for end(s) of, for example, a rotating body such as a toner carrier in an image-forming device in the context of electrophotography.

BACKGROUND ART

Conventional end seal members used in electrophotographic image-forming devices include sealing members comprising foamed bodies, sealing members comprising nonwoven fabrics, sealing members comprising implanted fibers, sealing members comprising piled woven fabrics, sealing members comprising knit fabrics, and so forth. The aforementioned sealing members are often used as end seal members at toner carriers where surfaces of rotating bodies constituting toner carriers are partially exposed.

Among these, as a seal structure at an end of a rotating body, a structure is disclosed in which there is a sleeve over which an inclined sealing member is affixed to form an inclined ridge, and this inclined ridge is employed as toner guide to control leakage of toner to the exterior (e.g., see Patent Reference No. 1). Furthermore, sealing members having structures equipped with inclined grooves have also been disclosed (e.g., see Patent Reference No. 2 or Patent Reference No. 3). Moreover, sealing structures have also been disclosed in which screen printing is used to cause application of steps comprising sealing members having projecting patterns serving as inwardly directed guides in axial directions on end sheets (e.g., see Patent Reference No. 4). Moreover, sealing members made from woven fabric members having projecting woven mesh interstices unlike those which are pile-woven have been disclosed (e.g., see Patent Reference No. 5 and Patent Reference No. 6).

However, with structures in which, to prevent leakage of toner, i.e., developer, which serves as toner in conventional electrophotographic image-forming devices, flow of toner is controlled so that leakage prevention can be carried out (e.g., see Patent Reference No. 1), there is occurrence of slight leakage of toner, and furthermore, the additional torque which acts on the sleeve is high. That is, where a guide member which causes return of toner is provided on a sleeve, because this guide member which causes return of toner is at one location sheet-like and engages in surface contact, as the area over which it contacts the sleeve is large and as it comprises a single-step guide member, there is increased tendency for leakage of toner to occur, and increased additional torque which acts on the sleeve.

Furthermore, at sealing members having structures equipped with inclined grooves (e.g., see Patent Reference No. 2 or Patent Reference No. 3), the sealing member is an elastic body, and because the elastic body is deformed by the drive force which is produced by contact with the develop roller, this causes weakening of the effect whereby toner is controlled and made to return.

Furthermore, with sealing structures that are applied by printing (e.g., see Patent Reference No. 4), because the guide comprises a step which is produced by screen printing, it is difficult to sharply form the edge which will serve as guide.

Moreover, with sealing members comprising woven fabric which does not possess cut pile but which is woven fabric in which the yarn is raised in wavelike fashion, peaks and valleys being arranged so as to be at different locations (e.g., see Patent Reference No. 7), because the peaks and valleys mutually differ with each different layer, such that a linear guide is not constituted therefrom, woven fabric having such wavelike structure will be of a structure that is unstable with respect to the upper and lower regions therein, and will be unsatisfactory for use as a sealing member.

Furthermore, in the foregoing sealing members that have structures in which steps comprising overlapping portions in a woven fabric are arranged in regular fashion so as to produce an inclined configuration (e.g., see Patent Reference No. 5 and Patent Reference No. 6), this is woven fabric which is woven in a weave pattern of a single type, being twill weave or oblique brocade weave, and this is a sealing member in which the woven mesh interstices where warp yarns and weft yarns intersect are formed in inclined fashion, warp yarns at the surface forming projecting woven mesh interstices having an inclined configuration, the warp yarns being parallel to the direction of rotation. For this reason, while projecting regions are formed in inclined fashion at the surface, because the warp yarns are in the direction of rotation, toner flows along the warp yarns, such that a structure is not achieved in which the effect due to projecting regions of inclined configuration permits flow of toner to be adequately controlled. Grease-like fluorinated lubricants have therefore been applied, and attempts have been made to improve seal characteristics as a result of effects produced by such lubricants, but it can hardly be said that such structures have been adequate as sealing members. Conventional sealing member art has thus not quite been capable of achieving sufficient practicality with respect to toner leakage and toner control, and it might also be said that the technological foundation has been less than clear.

PRIOR ART REFERENCES

Patent References

Patent Reference No. 1: Japanese Patent Application Publication Kokai No. H02[1990]-210476
Patent Reference No. 2: Japanese Utility Model Application Publication Kokai No. S60[1985]-191056
Patent Reference No. 3: Japanese Patent Application Publication Kokai No. H09[1997]-274380
Patent Reference No. 4: Japanese Patent Application Publication Kokai No. 2000-170919
Patent Reference No. 5: Japanese Patent Application Publication Kokai No. 2003-107902
Patent Reference No. 6: Japanese Patent Application Publication Kokai No. 2007-179080
Patent Reference No. 7: Japanese Patent Application Publication Kokai No. H11[1999]-194612

SUMMARY OF INVENTION

Problem to be Solved by Invention

A problem to be solved by the present invention, in the context of a sealing member for a toner handling device in an electrophotographic image processing device, is the provision of an end seal member comprising a sealing member which has good seal functionality and is economical, which permits reduction in loss of resources and reduction in the number of operations during fabrication, and which moreover is of high quality but of low cost.

Means for Solving Problem

Of the means in accordance with the present invention for solving the foregoing problems, a means in accordance with claim 1 is an end seal member for a toner carrier of an electrophotographic image-forming device, the end seal member for the electrophotographic image-forming device being characterized in that an end seal member is formed from a sheet-like member having a pattern of bands possessing recesses and projections in linear configuration which is worked into a desired shape by a cutting operation, and has an irregular surface comprising recessed regions and projecting regions in a pattern of bands comprising a plurality of steps in more or less linear configuration which contact a contacted surface of a rotating body constituting a toner carrier, and is a sealing member in which width of a recessed region is from 0.25 mm to less than one-half of an end seal width, and, when toner conveyed by the toner carrier comes in contact with a chamfered region or a radiused region at an edge of a projecting region at an irregular surface of a sealing member, an edge at a projecting region of a sealing member having recesses and projections causes a toner scraping angle formed by an edge of a projecting region which comes in contact with toner, a toner average particle diameter, and a radius of a toner carrier to be formed so as to be greater than an angle of repose of toner, and furthermore, this irregular surface in a pattern of bands comprising a plurality of steps in linear configuration has a toner control angle which is an angle causing toner to be returned toward an interior which is in a direction of a rotational axis of a toner carrier as a result of rotation of a rotating body constituting a toner carrier, and reactive-force-providing elasticity of an elastic body arranged at a back surface of a sealing member having an irregular surface, straddled by way of an intervening elastic body provided between an installation seat for a back surface of an end seal member and a rotating body, causes an irregular surface of a sealing member which contacts a rotating body to cause a recessed region to bend and be deformed toward a rotating body so as to contact a rotating body or so as to cause a gap between a recessed region and a rotating body to be formed so as to be a gap permitting transfer of toner scraped by a rotating body and so as to be less than or equal to a gap at which leakage does not occur at an acceleration less than or equal to 40 $m/s^2$, as a result of which leakage of toner from an end of a toner carrier is prevented.

A means in accordance with claim 2 is an end seal member for an electrophotographic image-forming device according to the means of claim 1 characterized in that the end seal member is formed from a sealing member having an irregular surface comprising recessed regions and projecting regions in a pattern of bands comprising a plurality of steps in linear configuration which contact a contacted surface of a rotating body constituting a toner carrier, and, when toner conveyed by the toner carrier comes in contact with a chamfered region or a radiused region at an edge of a projecting region at an irregular surface of a sealing member, an edge at a projecting region of a sealing member which comes in contact with toner causes a toner scraping angle to be formed which is greater than an angle of repose of toner, and a maximum radius at a radiused region of an edge at a projecting region constituting said scraping angle is 0.1 mm, and a material from which a radiused region is formed comprises a molded resin body or yarn comprising filament, and furthermore, this irregular surface in a pattern of bands comprising a plurality of steps in linear configuration is such that a toner control angle which is an angle causing toner to be returned toward an interior which is in a direction of a rotational axis of a toner carrier as a result of rotation of a rotating body constituting a toner carrier is formed during cutting into a desired seal shape, and is constituted such that reactive-force-providing elasticity of an elastic body, arranged at a back surface of a sealing member having an irregular surface, and straddled by way of an intervening elastic body by an installation seat for an end seal member and a toner carrier, causes an irregular surface of a sealing member which contacts a toner carrier to cause a recessed region to bend and be deformed toward a toner carrier, and a recessed region is made to bend and undergo deformation and contact a toner carrier so as to form a gap for transfer of toner at a corner of a recessed region, or so as to cause a gap between a recessed region and a rotating body to be formed so as to be a gap permitting transfer of toner scraped as a result of surface velocity or rotation of a toner carrier and so as to be less than or equal to a gap at which leakage does not occur at a desired acceleration, to prevent leakage of toner from an end of a toner carrier.

A means in accordance with claim 3 is an end seal member for an electrophotographic image-forming device according to the means of claim 2 characterized in that prevention of leakage of toner from an end of a toner carrier is determined from a step comprising an irregular surface at a sealing member relative to an outside diameter of a rotating body constituting a toner carrier, an edge at a projecting region, a width of a recessed region, a thickness of a recessed region, a material of a sealing member, a control angle of an irregular surface relative to a rotating body constituting a toner carrier, and a contact load; and based upon consideration of a gap for transfer of toner formed at a corner of a recessed region as a result of contact of a toner carrier and a recessed region, or based upon consideration of a gap which is a maximum of 100 μm at a recessed region and a rotating body constituting a toner carrier, a gap is formed such as will cause leakage to not occur at an acceleration less than or equal to 40 $m/s^2$, to prevent leakage of toner from an end of a toner carrier.

A means in accordance with claim 4 is an electrophotographic image-forming device according to the means of claim 2 characterized in that a sealing member from which an end seal member is formed is a material chosen from resin sheet comprising a molded resin body or striped woven fabric having steps comprising weave patterns of two types and using at least two or more yarns which are yarns comprising filaments which are continuous fibers, an integral seal member being obtained from this sealing member and a molded resin body constituting an elastic body which is provided at a back surface of this sealing member, a toner control angle which is an angle causing toner to be returned toward an interior in a direction of a rotational axis of a toner carrier as a result of a direction of rotation of a rotating body constituting a toner carrier is formed when this seal member sheet material is cut into a desired end seal shape, reactive-force-providing elasticity of an elastic body present at a back surface of a sealing member causing formation of a contact load due to compression toward a toner carrier, and furthermore, an irregular surface in a pattern of bands formed as a result of formation of a plurality of steps in linear configuration at a contacted surface of a rotating body constituting a toner carrier being made to contact an end of a toner carrier, to prevent leakage of toner from an end of a toner carrier.

A means in accordance with claim 5 is an electrophotographic image-forming device according to the means of any one of claims 1 through 4 characterized in that an end seal member formed in a desired shape using a sheet-like seal member in which a sealing member and an elastic body are combined in integral fashion is an end seal member that prevents leakage of toner from cleaning container for recovered toner by means of a cleaning blade at an electrophotographic image-forming device or an end seal member that prevents leakage of toner from a develop container having a develop roller at an image-forming device, being an end seal member used in at least one of a cleaning container or a develop container.

Benefit of the Invention

As compared with sealing members employing conventional guide members or steps, a means in accordance with the present invention is provided with a plurality of steps, radius or radii of curvature being set as required so that the edge(s) of projecting region(s) act as sealing member(s) at location(s) serving as projecting stripe-like guide(s) to control toner, and by causing angle(s) at which toner contacts edge(s) of projecting stripe-like region(s) to be larger than angle(s) of repose of toner, it is possible to definitively control toner, and to definitively cause toner to return toward interior(s) of rotating body or bodies by virtue of the linear constitution of the projecting stripe-like guide(s). Furthermore, this plurality of steps in accordance with the present invention employs a stable structure in which there is a stripe-like pattern of bands. Accordingly, the plurality of steps in accordance with the present invention has no unstable element, is of stable quality, and makes it possible for high quality to be maintained. Furthermore, as compared with devices in which seal structures having steps serving as guides applied by printing are affixed over conventional end seal members, there being no concern with respect to detachment of the plurality of steps of the present invention as would be the case if steps provided by printing were to be affixed thereto, quality is stable.

Moreover, piled woven fabrics are the mainstay for conventional woven fabric sealing members, but as these require pile density and length, the amount of yarn required to be used has been large. In contradistinction hereto, in accordance with a basic constitution of the present invention, a striped pattern of bands is constituted from a structure which is sheet-like or which is provided with steps produced by satin weave and plain weave or satin weave and twill weave, as a result of which seal functionality is achieved with a thickness that would correspond to the base fabric in a conventional pile weave, and thus, because there is no excessive material constitution, it is economical. Furthermore, with respect to the thickness of the sealing member, as there will basically be no problem with regard to scraping of toner so long as step(s) are step(s) which are larger than the diameter toner particles, even where gap(s) produced by step(s) are gap(s) constituted so as to be gap(s) such as will not result in leakage due to vibration or the like, such a constitution will present no problem.

EMBODIMENTS FOR CARRYING OUT THE INVENTION

Figure 1:
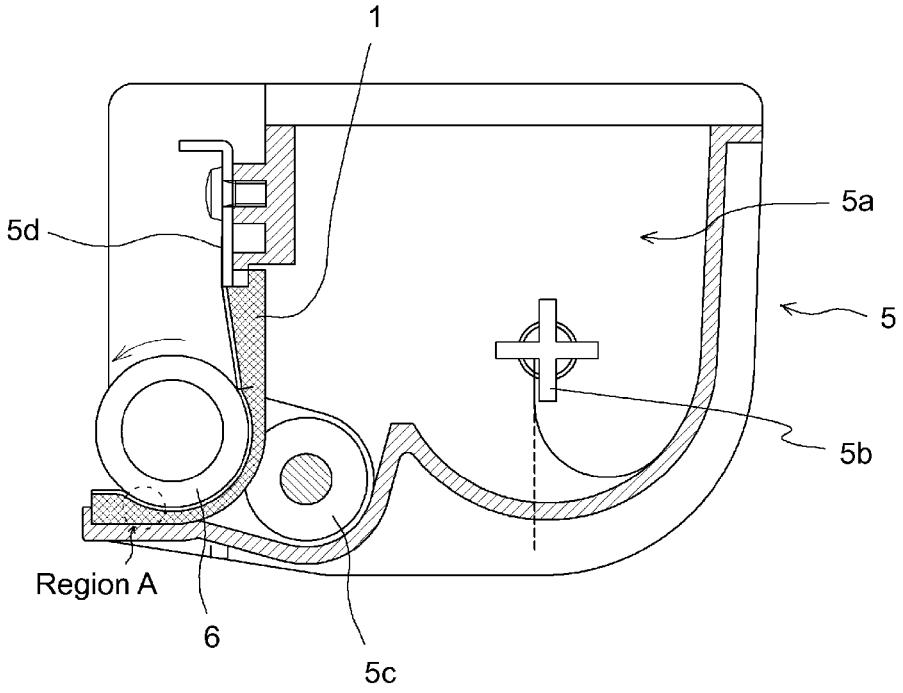
FIG. 1 Side view showing, except for transfer means which is not shown, an electrophotographic image-forming device comprising an agitation member for toner constituting toner, a supply roller, a develop roller constituting a toner carrier, an end seal member, a control blade, and so forth.

Below, embodiments for carrying out the present invention are described with reference to the drawings.

The present invention is an end seal member 1 at a toner carrier 6 which carries toner 7 in an electrophotographic image-forming device 5. This toner carrier 6 is formed from rotating body 6*a*. Furthermore, end seal member 1 has an irregular surface 2*a* where a pattern of bands 2*c* comprising a plurality of steps of linear configuration contacts contacted surface 6*c* of rotating body 6*a* constituting toner carrier 6, being formed such that the width of the recess is from 0.25 mm to a width which is less than one-half of the seal width. This end seal member 1 is formed so that, when toner 7 conveyed by toner carrier 6 constituting rotating body 6*a* comes in contact with chamfered region 4 and/or radiused region 3 at edge 2*e* of projecting region 2*d* and recessed region 2*f* at irregular surface 2*a* of sealing member 1*a*, the angle 8 at which toner 7 is scraped by edge 2*e* of projecting region 2*d* and recessed region 2*f* which come in contact with the toner 7 is larger than the angle 7*a* of repose of the toner 7 at FIG. 15. In addition, this irregular surface 2*a* in a pattern of bands 2*c* comprising a plurality of steps of linear configuration forms a toner control angle 10, which is an angle permitting toner 7 to be returned by rotation of rotating body 6*a* toward the interior 6*f* which is in the direction 6*e* of the axis of rotation of rotating body 6*a*. Moreover, recessed region 2*f* of irregular surface 2*a* at sealing member 1*a* which contacts rotating body 6*a* is straddled by installation seat 1*d* for sealing member 1*a* and rotating body 6*a* by way of intervening elastic body or bodies. In addition, reactive-force-providing elasticity of elastic body 11 arranged at back surface 1*e* of sealing member 1*a* and imparting contact load between installation surface 1*d* for sealing member 1*a* and rotating body 6*a* causes recessed region 2*f* to bend and be deformed toward rotating body 6*a*, such that it contacts rotating body 6*a* and prevents leakage of toner 7 from end 6*d* of rotating body 6*a*. Alternatively, leakage of toner 7 from end 6*d* of rotating body 6*a* might be prevented by causing the gap 13 between rotating body 6*a* and recessed region 2*f* to be formed so as to be a size which is less than or equal to the size of a gap which will allow toner 7 to be conveyed by rotating body 6*a*, and which is less than or equal to the size of a gap 15 at which leakage does not occur at a desired acceleration, e.g., at accelerations less than or equal to 40 $m/s^2$.

Moreover, end seal member 1 at toner carrier 6 in electrophotographic image-forming device 5 of the present invention is such that scraping, i.e., cleaning, of toner 7 is carried out in stable fashion in correspondence to characteristics of toner 7, rotation of toner carrier 6 which has a gap 13 that permits movement of toner 7 therethrough causing toner 7 which has been scraped off to be returned to toner carrier 6 at a prescribed angle, preventing leakage of toner 7 to the exterior.

At recessed region 2*f* and projecting region 2*d* which are present at this end seal member 1, when edge 2*e* between recessed region 2*f* and projecting region 2*d* contacts toner carrier 6, as scraping angle 8 is provided in such fashion as to be an angle larger than the angle 7*a* of repose of toner 7, toner 7 scraped by this scraping angle 8 is made to settle into the stepped gap region formed by recessed region 2*f* and projecting region 2*d*, and is made to return to the toner receptacle via the stepped gap region as a result of the conveying force in the direction 6*e* of the axis of rotation of the toner carrier 6 and as a result of the conveying force in the direction of the thrust due to the toner control angle 10 for control of flow.

Figure 2:
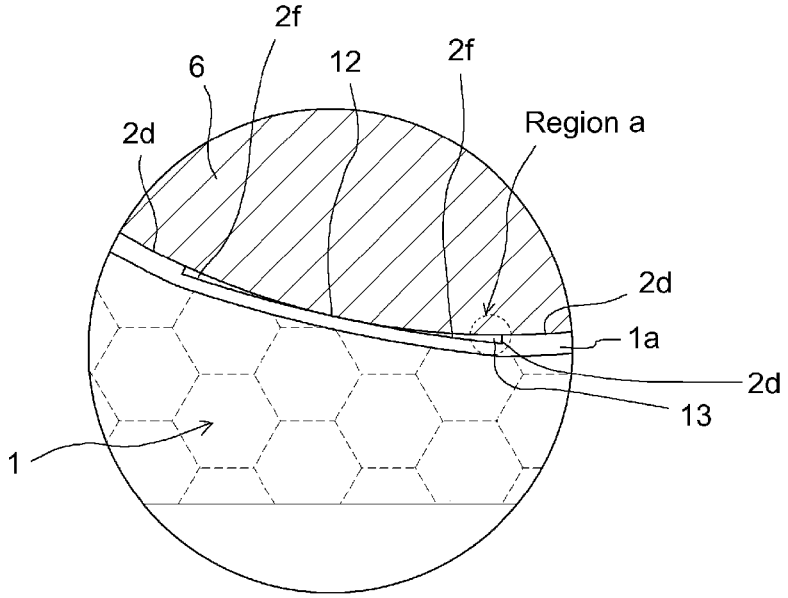
FIG. 2 Schematic enlarged view showing a toner scraping member at an end seal member.
Figure 3:
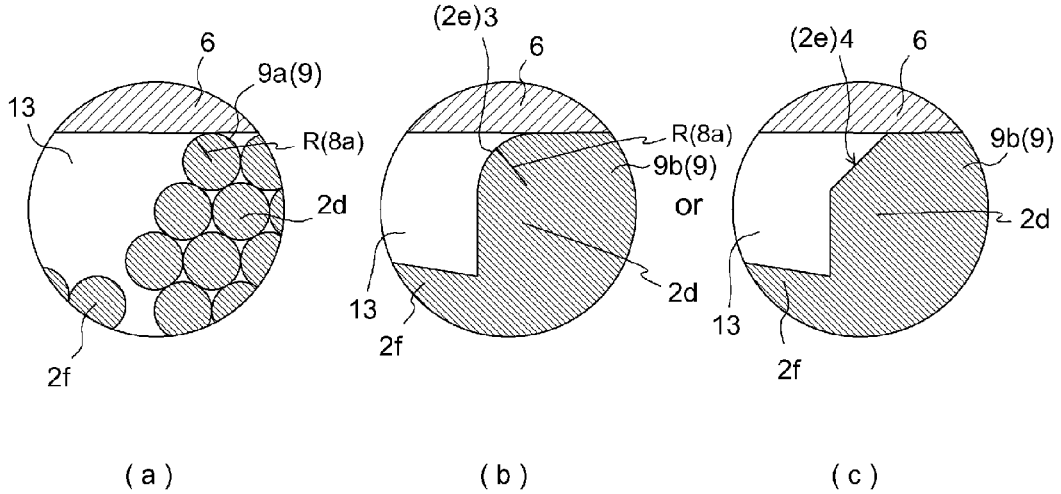
FIG. 3 Schematic view showing detail of a member comprising a molded part having a chamfered region and a member comprising a molded part having a radiused region and a member comprising fiber(s) at the schematic enlarged view of FIG. 2.

FIG. 1 shows electrophotographic image-forming device 5 in which there are arranged an agitator 5*b* (agitation member) for toner 7, a supply roller 5*c*, a develop roller constituting toner carrier 6, end seal member 1, control blade 5*d*, and so forth. FIG. 2 is an enlarged view of circled region A of toner carrier 6 and end seal member 1 at FIG. 1. FIG. 3, in a still further enlarged view of region a at FIG. 2, is a schematic enlarged view of circled region a which includes a portion of gap 13 between toner carrier 6 and recessed region 2*f* of end seal member 1, (a) at FIG. 3 showing a portion of toner carrier 6 and a portion of a step between a projecting region 2*d* and a recessed region 2*f* comprising filaments 9*a* constituting material 9 of woven fabric 1*c*, the region above recessed region 2*f* which comprises filaments 9*a* constituting gap 13; (b) at FIG. 3 comprising molded resin body 9*b* instead of the filaments 9*a* in material 9 of woven fabric 1*c* at (a), projecting region 2*d* comprising radius R of radiused region 3; and (c) at FIG. 3 being a region for scraping of toner 7 in which a chamfered region 4 is employed instead of the radiused region 3 of projecting region 2*d* at (b).

Figure 4:
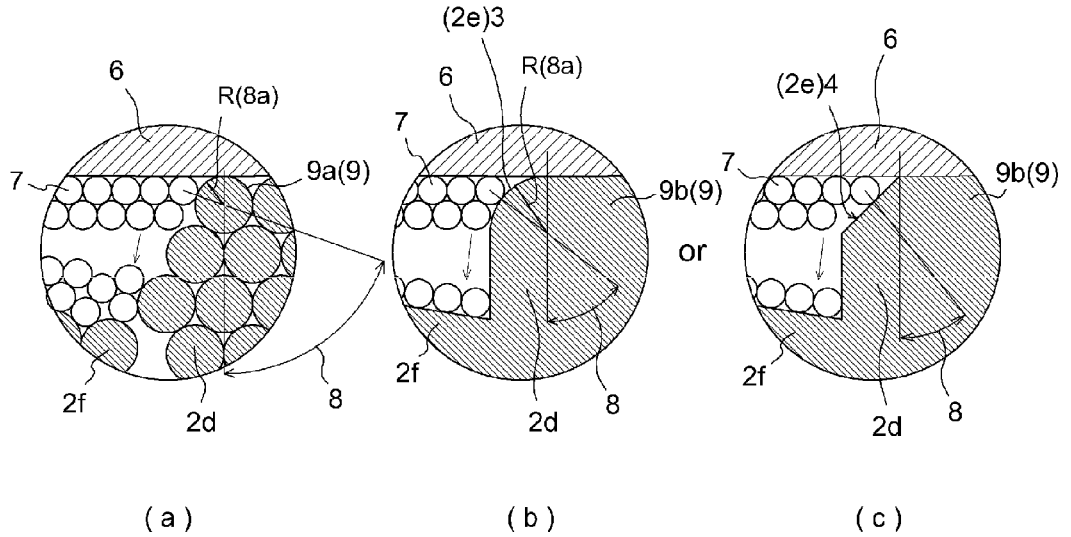
FIG. 4 Schematic diagram showing scraping of toner by the toner scraping member at FIG. 3.
Figure 5:
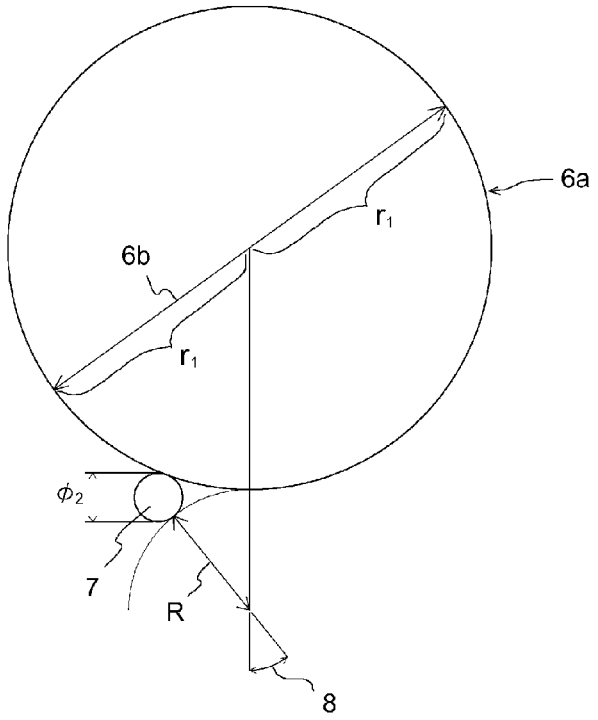
FIG. 5 Drawing showing principle behind scraping of toner.
Figure 15:
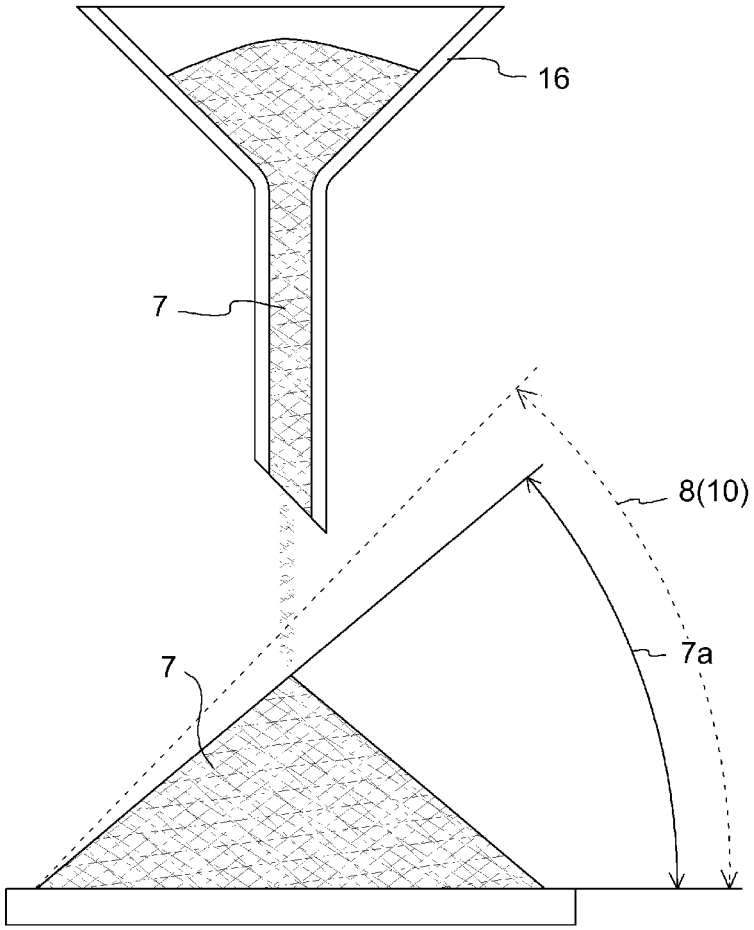
FIG. 15 Drawing showing a method for measuring angle of repose, which is a measure of toner flow characteristics.

FIG. 4 and FIG. 5 show in schematic fashion the principle behind scraping of toner 7. As shown in FIG. 4, scraping causes particles of toner 7 to fall from where they are at a location near toner carrier 6 to a location toward recessed region 2*f*, as indicated by the arrow. This scraping angle 8 is constituted so as to be larger than the angle 7*a* of repose of toner 7 shown in FIG. 15, angle 7*a* of repose in FIG. 15 being determined based on chamfered region 4 or radiused region 3 of edge 2*e* between recessed region 2*f* and projecting region 2*d* in FIG. 3 and FIG. 4 and outside diameter 6*b*, i.e., $r_1 \times 2$, of toner carrier 6 and diameter $\phi_2$ of toner 7 shown in FIG. 5. The angle 7*a* of repose shown in FIG. 15 is a measure of the flow characteristics of toner 7, the smaller the angle 7*a* of repose the better the flow characteristics and the greater the tendency for toner 7 to flow. It is moreover said that the angle 7*a* of repose of toner 7 is 20° to 70°. Noteworthy thereamong, conglobated toner 7 has an angle 7*a* of repose which is around 30° and has good flow characteristics. On the other hand, toner 7 formed by pulverization has an angle 7*a* of repose which is around 40°. By the present invention, control of toner 7 by an angle which is larger than the angle 7*a* of repose of toner 7 was discovered. By therefore using a toner control angle 10 which is a scraping angle 8 that is larger than angle 7*a* of repose of toner 7 shown in FIG. 15 to control toner 7 so as to prevent toner 7 from sliding past sealing member 1*a*, toner 7 is scraped off, toner 7 being at that angle made to assume a state in which it slides down therefrom, as shown in FIG. 4.

Figure 6:
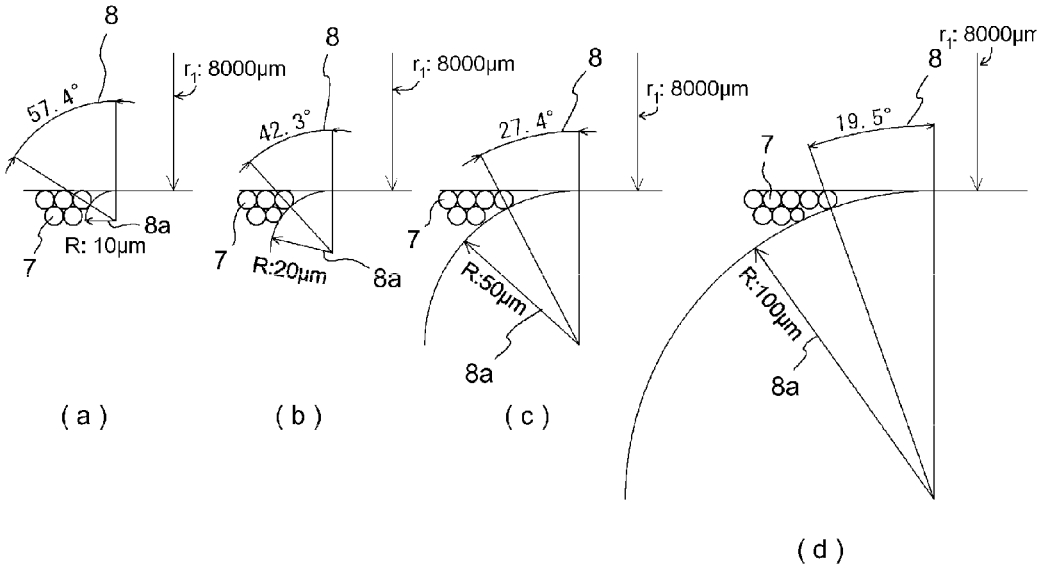
FIG. 6 Schematic diagram showing scraping angle when scraping radius is varied for a toner particle diameter of 6 μm.
Figure 7:
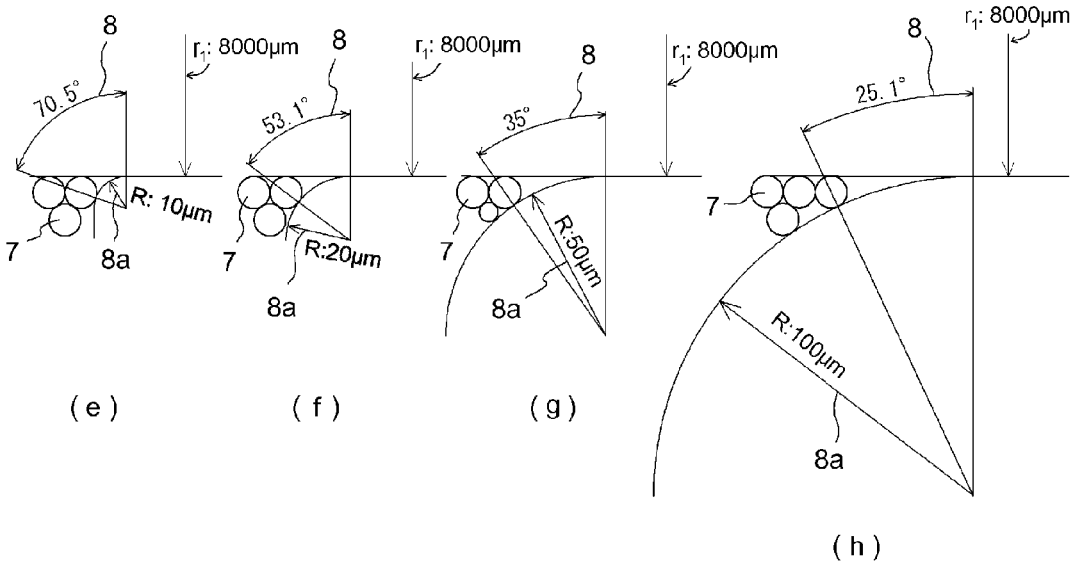
FIG. 7 Schematic diagram showing scraping angle when scraping radius is varied for a toner particle diameter of 10 μm.

FIG. 6 shows scraping angles 8 of respectively 57.4°, 42.3°, 27.4°, and 19.5° when radiused region 8*a* constituting scraping angle 8 of projecting region 2*d* at a step comprising irregular surface 2*a* at sealing member 1*a* which contacts radius $r_1$ 8000 μm of toner carrier 6 is varied such that R=10 μm at (a) in FIG. 6, R=20 μm at (b) in FIG. 6, R=50 μm at (c) in FIG. 6, and R=100 μm at (d) in FIG. 6, when particle diameter of toner 7 is 6 μm. Moreover, FIG. 7 shows scraping angles 8 of respectively 70.5°, 53.1°, 35.0°, and 25.1° when radiused region 8*a* constituting scraping angle 8 of projecting region 2*d* at a step comprising irregular surface 2*a* at sealing member 1*a* which contacts radius $r_1$=8000 μm of toner carrier 6 is varied in similar fashion as at FIG. 6 such that R=10 μm at (e) in FIG. 7, R=20 μm at (f) in FIG. 7, R=50 μm at (g) in FIG. 7, and R=100 μm at (h) in FIG. 7, when particle diameter of toner 7 is 10 μm. By thus causing radiused region 8*a* of scraping angle 8 to be made small, scraping angle 8 is made large, as a result of which there is less tendency for toner 7 to be trapped therewithin, increasing the ease with which it is scraped off by sealing member 1*a*.

Figure 8:
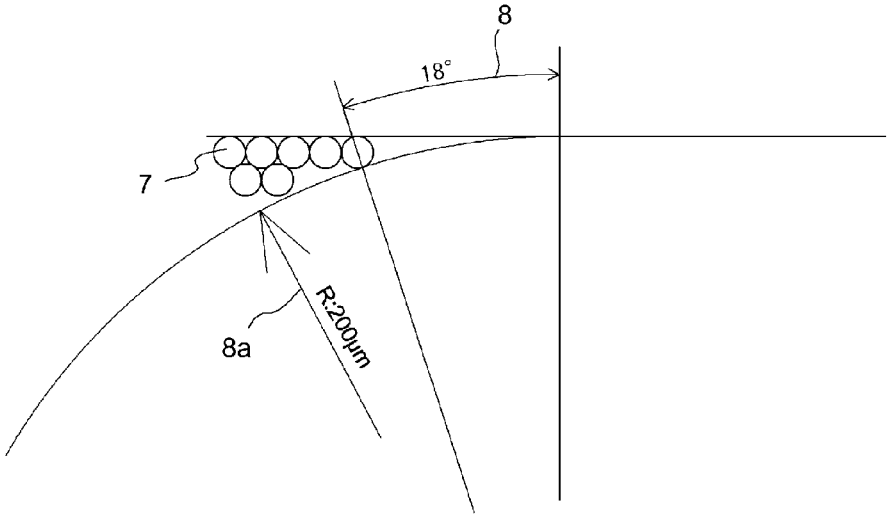
FIG. 8 Schematic diagram of when recessed region radius has been made large as compared with toner.

In contradistinction hereto, if, as shown in FIG. 8, radiused region 8*a* of scraping angle 8 is made large such that, for example, R=200 μm, this will cause scraping angle 8 to be 18°, which is small, increasing tendency for toner 7 to be trapped therewithin and resulting in a situation in which it is more difficult for toner 7 to be scraped off.

Moreover, due to presence of step(s) comprising irregular surface 2*a* at sealing member 1*a*, a region is formed in which there is a gap 13 where the force of contact between sealing member 1*a* and toner carrier 6 does not act at edge 2*e* between recessed region 2*f* and projecting region 2*d* of the step(s), the conveying force produced by rotation of toner carrier 6 making it possible for toner 7 to move through this gap 13. Moreover, a condition is established by which the shape of recessed region 2*f* is deformed and leakage is discouraged so as to prevent leakage of toner 7 due to vibration from the region 12 at which contact occurs between toner carrier 6 and recessed region 2*f* of sealing member 1*a* which is formed from stripes in a pattern of bands 2*c* comprising irregular surface 2*a* at steps comprising recessed region(s) 2*f* and projecting region(s) 2*d*, or from gap 13 where it most closely approaches this recessed region 2*f*. This condition comprises toner control angle 10, the load with which sealing member 1*a* is contacted, the material of sealing member 1*a*, the thickness 2*h* of recessed region 2*f* at sealing member 1*a*, and the recess width which is the width 2*g* of the recessed region 2*f* between projecting regions 2*d*, at the step(s) comprising recessed region(s) 2*f* and projecting region(s) 2*d* at sealing member 1*a*. Moreover, a gap permitting movement of toner 7 therethrough is formed at edge 2*e* of projecting region 2*d* at irregular surface 2*a*, the constitution being such that the force by which toner 7 is conveyed, i.e., a force causing rotation in the direction of rotation of toner carrier 6, causes toner 7 to be returned toward the interior of toner carrier 6 as flow of toner 7 is controlled by toner control angle 10 comprising irregular surface 2*a* of sealing member 1*a*.

Figure 9:
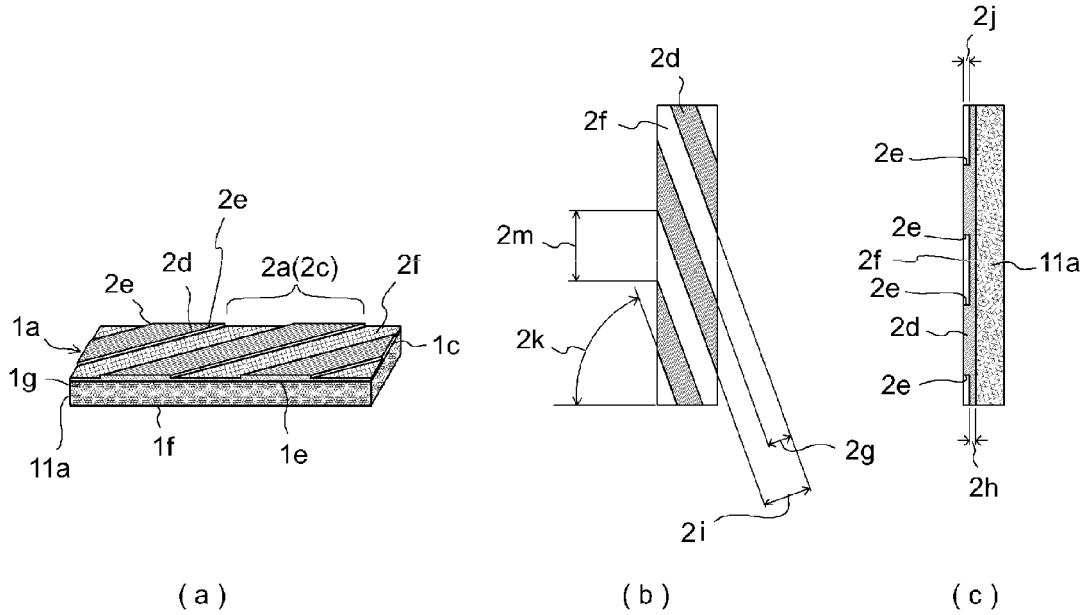
FIG. 9 Drawing showing constitution of sealing member.

FIG. 9 shows constitution of this rectangular sealing member 1*a*. Sealing member 1*a* shown at (a) in FIG. 9 has woven fabric 1*c* which has stripes in a pattern of bands 2*c* comprising steps which comprise irregular surface 2*a* having recessed regions 2*f* and projecting regions 2*d*, foamed polyurethane elastic layer 11*a* which is present at back surface 1*e* of this woven fabric 1*c* by way of intervening adhesive layer 1*g*, and two-sided adhesive tape if which is applied to this elastic layer 11*a*. At (b) in FIG. 9, width of the recessed region 2*f* at this rectangular sealing member 1*a* is indicated as 2*g*, pitch width comprising recessed region 2*f* and projecting region 2*d* of the step is indicated as 2*i*, angle of inclination as measured from the short side of the stripe at the inclined pattern of bands 2*c* at rectangular sealing member 1*a* is indicated as 2*k*, and width of the recessed region along the long side of the sealing member is indicated as 2*m*. Furthermore, at (c) in FIG. 9, step height is indicated as 2*j*.

Figure 10:
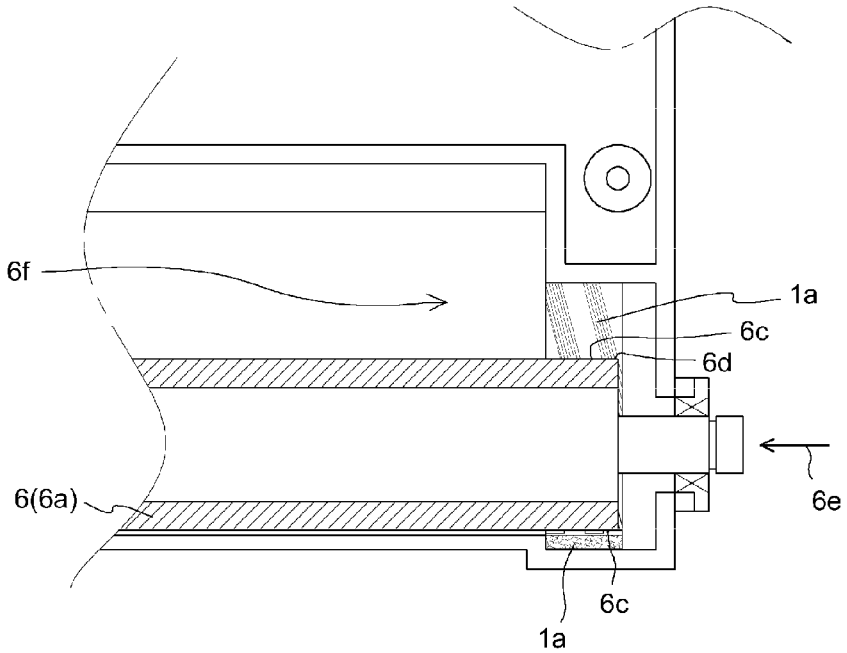
FIG. 10 Drawing showing installation of sealing member and direction of flow of toner.

FIG. 10 shows orientation of stripes in a pattern of bands 2*c* at sealing member 1*a* which contacts rotating body 6*a* constituting toner carrier 6, i.e., develop roller, of image-forming device 5. This orientation of stripes in pattern of bands 2*c* indicates the direction of flow of toner 7, toner 7 being made to return toward the interior of the container of the develop roller which contacts toner carrier 6 from a location toward the end along the axis of rotation of the develop roller, without occurrence of leakage from the container to the exterior, when the end at the right side of the develop roller constituting toner carrier 6 rotates in the counterclockwise direction.

Figure 11:
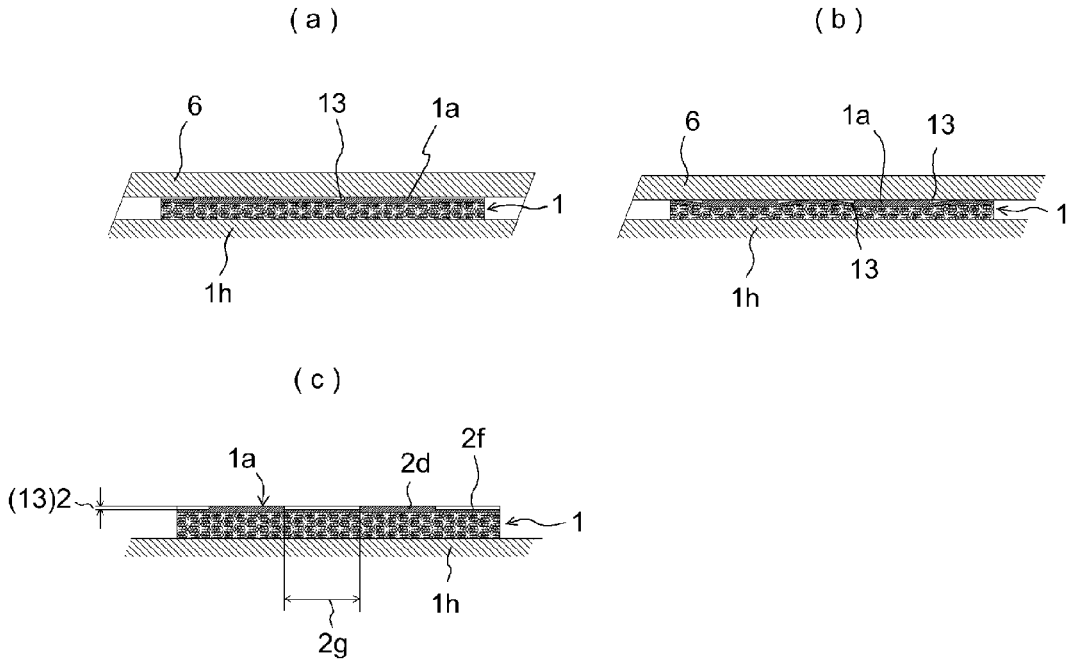
FIG. 11 Drawing showing how a recessed region assumes a deformed state when a sealing member is compressed and showing the situation when there is no load.

FIG. 11 shows sealing member 1*a* which has been applied to seal member application region 1*h*, (a) and (b) showing how recessed region 2*f* assumes a deformed state when sealing member 1*a* is compressed, and (c) showing the situation at recessed region 2*f* when not under load, i.e., when sealing member 1*a* is uncompressed. At (a) in FIG. 11, sealing member 1*a* being compressed, gap 13 between toner carrier 6 and sealing member 1*a* is made narrow, a narrow gap 13 being present throughout the entire region above recessed region 2*f* in the example shown. That is, at (b) in FIG. 11, while sealing member 1*a* is similarly compressed, a narrow gap 13 is present only at edge 2*e* of projecting region 2*d* of the step in the example shown. At (c) in FIG. 11, sealing member 1*a* does not contact toner carrier 6, and so because it is not under load and is uncompressed, above the recessed region 2*f* of the step there is a gap 13 present which comprises the height 2*j* of the step. As shown in this FIG. 11, at sealing member 1*a* having irregular surface 2*a* containing a plurality of recessed regions 2*f* and projecting regions 2*d*, recessed region 2*f* is deformed as a result of bending due to the load which acts thereon, causing the excessive gap 13 to be reduced, which makes it possible to prevent leakage of toner 7 that might otherwise occur due to vibration or the like, while also making it possible for this gap 13 to be made a gap 15 such as will permit toner 7 to be conveyed by toner carrier 6 at location(s) where scraping is required.

Figure 12:
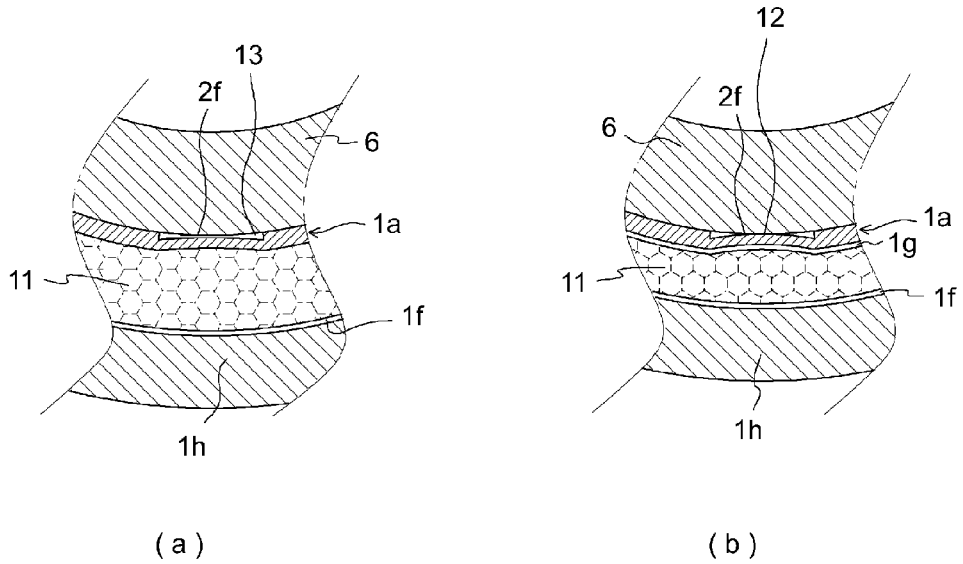
FIG. 12 Enlarged view of when a toner carrier and a sealing member are in compressive contact.

FIG. 12 shows a partial enlarged view of toner carrier 6 and sealing member 1*a*. (a) in FIG. 12 shows a situation in which, when uncompressed, gap 13 is present at recessed region 2*f* of sealing member 1*a*; and (b) in FIG. 12 shows how, when compressed, a portion of recessed region 2*f* of sealing member 1*a* bends and contacts toner carrier 6, i.e., the develop roller, to form contact region 12. While not shown, note that where, when compressed, a portion of recessed region 2*f* of sealing member 1*a* has been bent and deformed in this way, elasticity of elastic body 11 may permit a gap 13 of a certain size to be formed between it and toner carrier 6.

Figure 13:
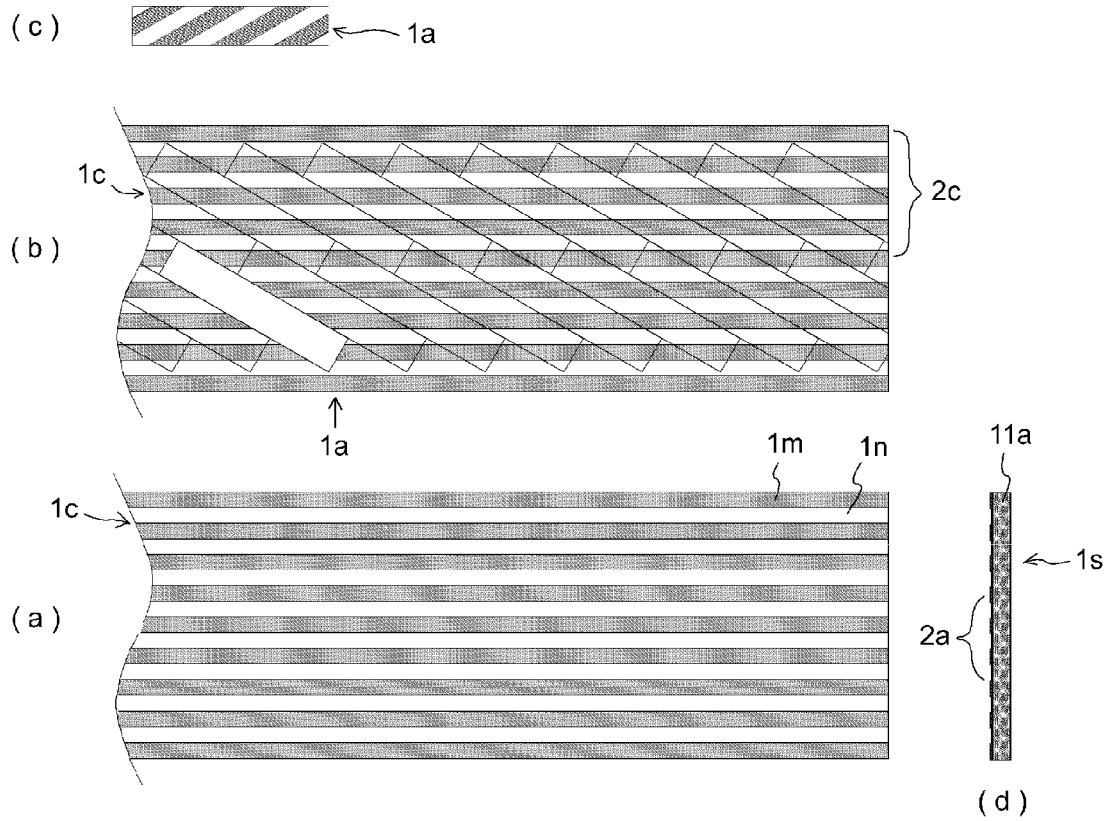
FIG. 13 Drawing showing end seal member shape which is kiss-cut or die-cut from sheet(s) of seal member stock.

FIG. 13 shows how, for example, sealing member stock comprising elastic foam and woven fabric 1*c* having step(s) comprising satin weave 1*m* and plain weave 1*n* might be kiss-cut or die-cut to fabricate sealing member 1*a* having step(s). During manufacture of end seal member 1, following cutting, excess portions at locations other than end seal member 1 are removed from release paper which protects the back surface of two-sided adhesive tape if which is provided at the back side of the woven fabric 1*c* sheet member stock. At FIG. 13, (a) is a plan view of woven fabric 1*c* stock, (b) is a plan view showing how stripes in a pattern of bands 2*c* at this woven fabric 1*c* stock are inclined at a prescribed angle and are kiss-cut or die-cut, and (c) is a plan view showing sealing member 1*a* obtained as a result of cutting and having stripes in a pattern of bands 2*c* at steps. Moreover, step(s) at sealing member 1*a* may also be manufactured from molded resin body 9*b* instead of the foregoing woven fabric, (d) at FIG. 13 showing a side view of seal member is which has an irregular surface 2*a* at step(s) at which there an elastic body 11 at the back surface.

Figure 14:
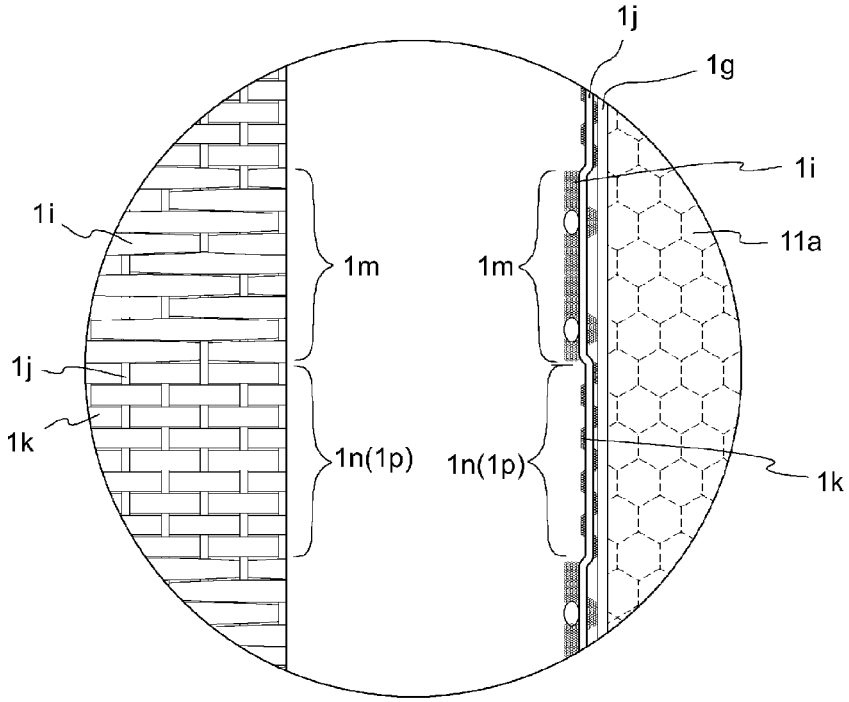
FIG. 14 Drawing showing how steps are formed that comprise woven fabric serving as a seal member.

FIG. 14 is a drawing showing constitution in which steps are formed that comprise woven fabric 1*c* serving as sealing member 1*a*. As shown in this drawing, woven fabric 1*c* comprises combination of satin weave 1*m* and plain weave 1*n* or satin weave 1*m* and twill weave 1*p*, the portion made in satin weave 1*m* being of high thickness, and the portion made in plain weave 1*n* or twill weave 1*p* being of low thickness. As shown at the right side in FIG. 14, warp yarn 1*i* at the yarn used at the portion made in satin weave 1*m* is soft-twist yarn comprising a plurality of filaments, being made up of filaments of diameters which are such that the radii thereof are less than or equal to 50 μm. Filament cross-section may be of modified cross-section or may have a cross-section comprising split fiber(s); weft yarn 1*j* employs monofilament. On the other hand, so as to cause the portion made in plain weave 1*n* or twill weave 1*p* to be of low thickness, pitch of the warp yarn 1*k* used at the portion made in plain weave 1*n* or twill weave 1*p* is made greater than or equal to the yarn diameter, and in addition, soft-twist yarn is used for this warp yarn 1*k*, the constitution being such that warp yarn 1*k* is made to spread out over the monofilament that is the weft yarn 1*j*.

FIG. 15 is a drawing showing a method for measuring angle 7*a* of repose which is a measure of the flow characteristics of toner 7. This angle 7*a* of repose is also called the repose angle or the angle of rest, and as shown in FIG. 15, when toner 7 is made to fall from a funnel 16 or the like so as to be deposited onto a horizontal surface, the angle formed by the horizontal surface and the surface of the cone which is formed by the falling toner 7 is the angle 7*a* of repose. Using this method shown in FIG. 15, as a result of measuring the angle 7*a* of repose of conglobated toner 7 of average particle diameter 6.0 μm and pulverized toner 7 of average particle diameter 8.0 μm which were used in the present testing, the angle 7*a* of repose of the conglobated toner 7 was found to be 27°, and the angle 7*a* of repose of the pulverized toner 7 was found to be 38°.

Figure 16:
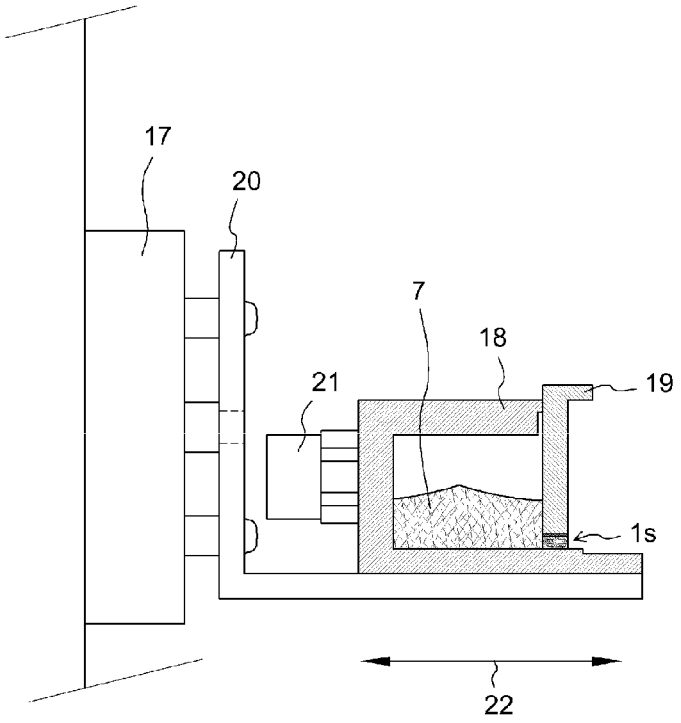
FIG. 16 Simplified view of vibration testing apparatus.

FIG. 16 is a side view showing in simplified fashion a schematic cross-section of a vibration testing apparatus. The vibration testing apparatus has vertically oriented cover 19 at the front face of toner box 18 which is attached by angle bar 20 to vibration source 17, sealing member is which is the material to be evaluated by testing being applied at the bottom face of this cover 19, toner 7 being housed within the toner box, the front face of toner box 18 being closed by cover 19 to which sealing member 1*a* has been applied, toner box 18 being made to vibrate in vibration direction 22 by vibration source 17, and leakage of toner 7 past sealing member 1*a* of cover 19 from toner box 18 being measured. Magnitude of vibration at such time is measured by pickup sensor 21.

Figure 17:
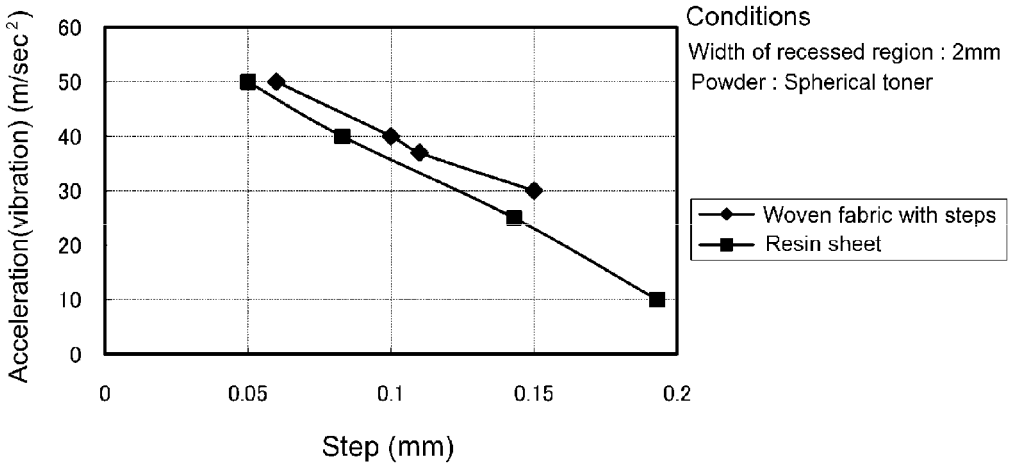
FIG. 17 Graph showing relationship between step and acceleration due to vibration during toner leakage testing of sealing member.

The graph at FIG. 17 shows results of vibration testing done using the foregoing vibration testing apparatus to test toner leakage at sealing member 1*a* by itself in which irregular surface 2*a* is formed from recessed regions 2*f* and projecting regions 2*d*. Here, width 2*g* of the recess at sealing member 1*a* was 2 mm, and toner 7 was conglobated toner 7, average particle diameter of which was 6.0 μm. As shown in FIG. 17, with respect to leakage of toner 7 where step(s) are present, presence at sealing member 1*a* of step(s) less than or equal to 0.1 mm is preferred, less than or equal to 0.05 mm being more preferred, for ability to withstand acceleration due to vibration during transport of toner 7 in image-forming device 5, i.e., 3 G (29.4 $m/s^2$), in the worst case for which leakage of the sealing member was tested. Note that as a result of measurement of vibrations within the device it was found that these were less than or equal to 5 $m/s^2$.

Figure 18:
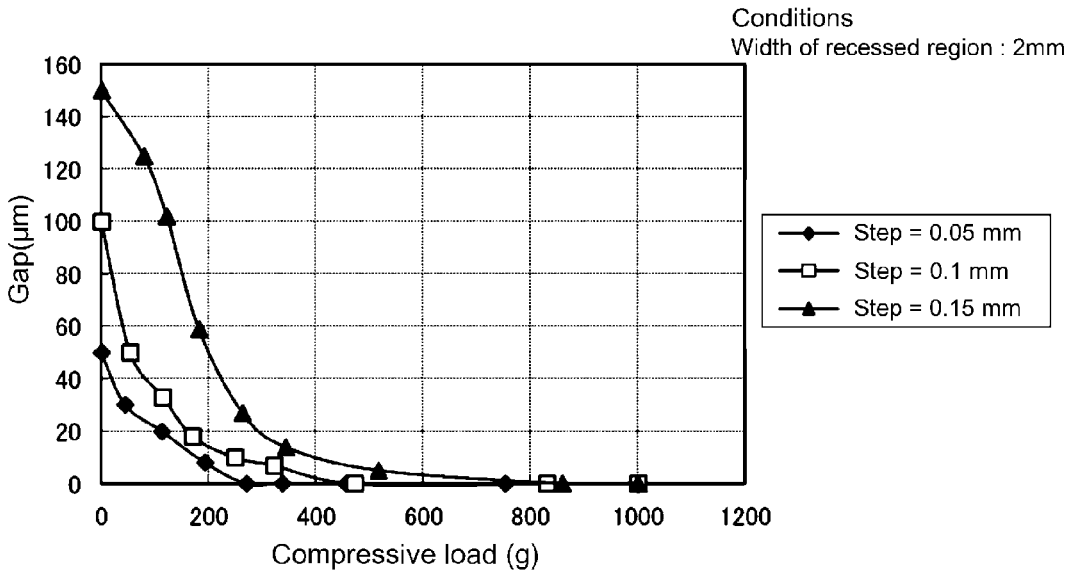
FIG. 18 Graph showing relationship between compressive load at sealing member and gap at recessed region.

As end seal member 1, foamed polyurethane elastic layer 11*a* constituting elastic body 11 was provided at the back surface of sealing member 1*a* having step(s) comprising woven fabric 1*c*, a load was applied to sealing member 1*a*, compressing it as shown in FIG. 11, and gap 13 obtained after deformation due to bending of recessed region 2*f* at sealing member 1*a* having step(s) was measured, the results of which are shown in the graph at FIG. 18. A condition applicable to this sealing member 1*a* is that the width of recessed region 2*f* is 2 mm. Based on this graph at FIG. 18, it was confirmed for sealing members 1*a* having respective steps that application of a compressive load causes recessed region 2*f* to bend and be deformed such that gap 13 is made narrow.

Figure 19:
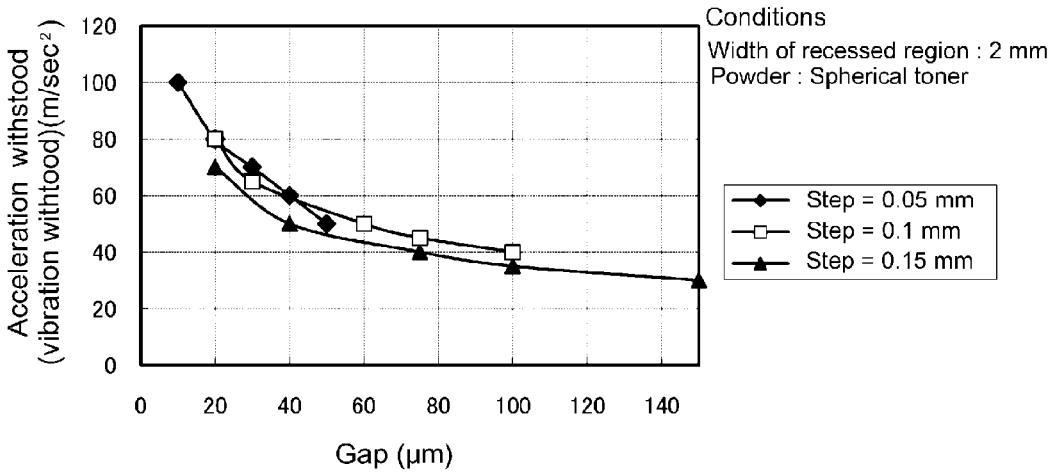
FIG. 19 Graph showing relationship between gap at sealing member and ability to withstand acceleration due to vibration.

Foamed polyurethane elastic layer 11*a* constituting elastic body 11 was provided at the back surface of three varieties of sealing member 1*a* having steps which were 0.05 mm, 0.1 mm, and 0.15 mm, and the vibration testing apparatus shown in FIG. 16 was used to confirm leakage of toner 7 from sealing member 1*a*, the results of which are shown in the graph at FIG. 19, acceleration due to vibration being indicated on the vertical axis, and gap 13 being indicated on the horizontal axis. Under these test conditions, width of the recessed region was 2 mm, and toner 7 was conglobated toner 7 having an average particle diameter of 6.0 μm. As shown in FIG. 19, gap 13 at toner 7 sealing member 1*a* is around 0.1 mm (100 μm), and as acceleration due to vibration increases along the curve, there is less tendency for leakage of toner 7 to occur as compared with the situation where this is less than or equal to around 0.05 mm (50 μm).

Figure 20:
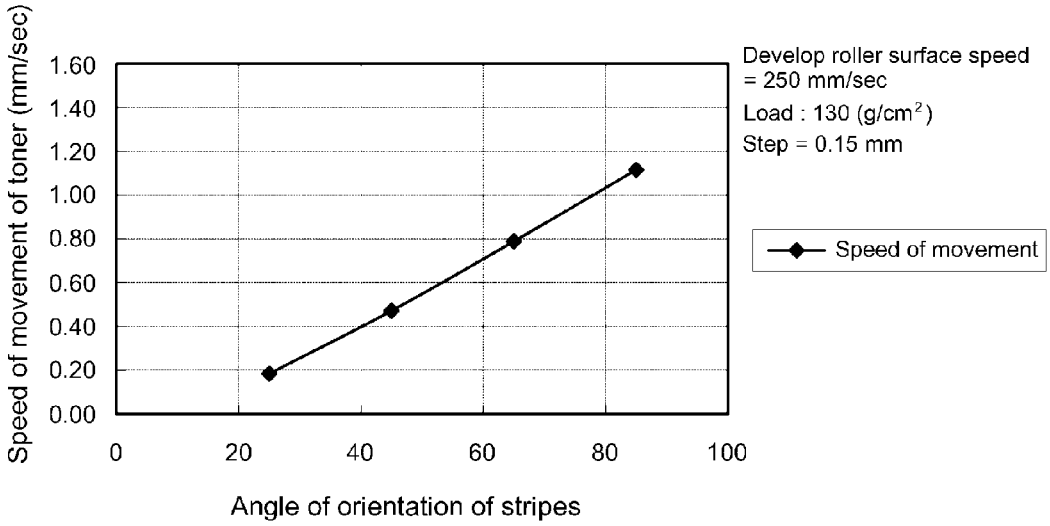
FIG. 20 Graph showing relationship between angle of orientation of stripes at sealing member and speed of movement of toner.

Foamed polyurethane elastic layer 11*a* constituting elastic body 11 was provided at the back surface of sealing member 1*a* comprising woven fabric 1*c* having stripes constituting steps, two-sided adhesive tape if was applied to the back surface of that elastic layer 11*a*, toner control angle 10 which was the orientation of the stripes comprising the recesses and projections at the steps was made to be a prescribed angle, this was made to contact the develop roller which constituted toner carrier 6, and the speed of movement of toner 7 was measured for several toner control angles 10, this being shown at the graph in FIG. 20. Conditions at this time were such that velocity at the surface of the develop roller was 250 mm/s, load was 130 $g/cm^2$, the step was 0.15 mm, and toner 7 was conglobated toner. As shown in FIG. 20, increasing the toner control angle 10 for control of toner 7 makes it possible to slow down the speed of movement of toner 7, and decreasing toner control angle 10 makes it possible to speed up the speed of movement of toner 7, toner control angle 10 making it possible to adjust the speed of movement of toner 7. That is, because toner control angle 10 can be set in correspondence to the rotational speed of rotating body 6*a* at toner carrier 6 in image-forming device 5, by causing this to rotate (move) at a speed greater than the speed of entry of toner 7, it will be possible to prevent entry of toner thereinto. Accordingly, toner control angle 10 should be set as appropriate in correspondence to the device. With respect to application of the elastic body to the striped woven fabric which is the sealing member, note that while there are application methods employing two-sided adhesive tape and application methods employing adhesive, application through use of adhesive is the more preferred based upon considerations of prevention of stringiness during cutting.

Figure 21:
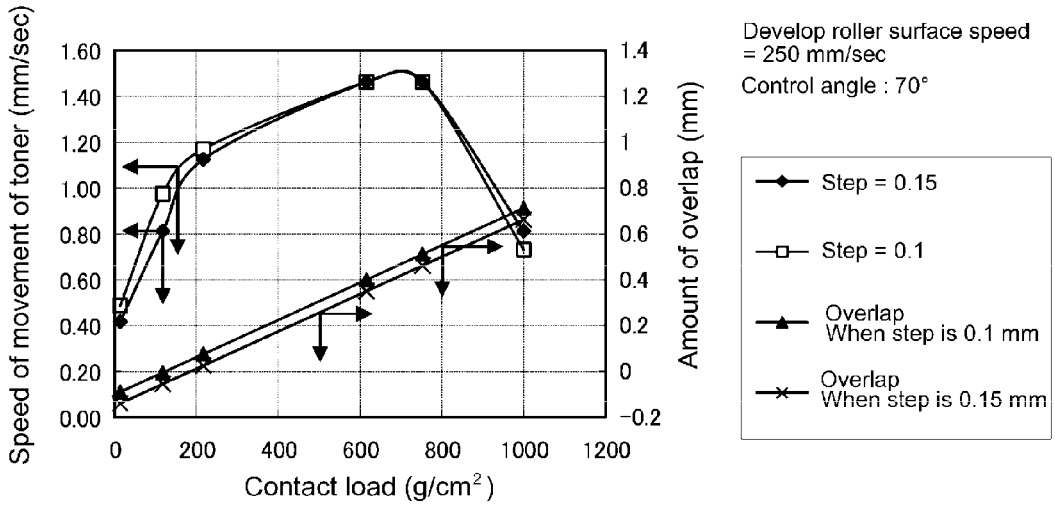
FIG. 21 Graph showing relationship between contact load and speed of movement of toner and relationship between contact load and amount of overlap at toner carrier due to amount of deformation due to amount of bending of recessed region.

The relationship between the contact load between the develop roller, i.e., toner carrier 6, and sealing member 1*a* and the speed of movement of toner 7, and the relationship between the amount of overlap at toner carrier 6, i.e., the amount of bending of recessed region 2*f* at sealing member 1*a* less the thickness of the step, and contact load, are shown in the graph at FIG. 21. As shown in FIG. 21, as contact load increases, the speed of movement of toner 7 exhibits two inflection points. At the first location, speed of movement increases linearly with increasing contact load, speed of movement increasing gradually after passing through a primary inflection point; while at the second location, speed of movement of toner 7 decreases after passing through a secondary inflection point. This phenomenon is such that contact load and the amount of overlap cause the primary inflection point to be the location at which recessed region 2*f* contacts toner carrier 6, this contact causing the speed of movement of toner to increase still more. However, as can be seen at the secondary inflection point, speed of movement of toner 7 decreases in contrary fashion for large contact loads. This is due to the fact that because gap 13 at edge 2*e* between recessed region 2*f* and projecting region 2*d* has become too small, movement of toner 7 is constrained and speed decreases.

Figure 22:
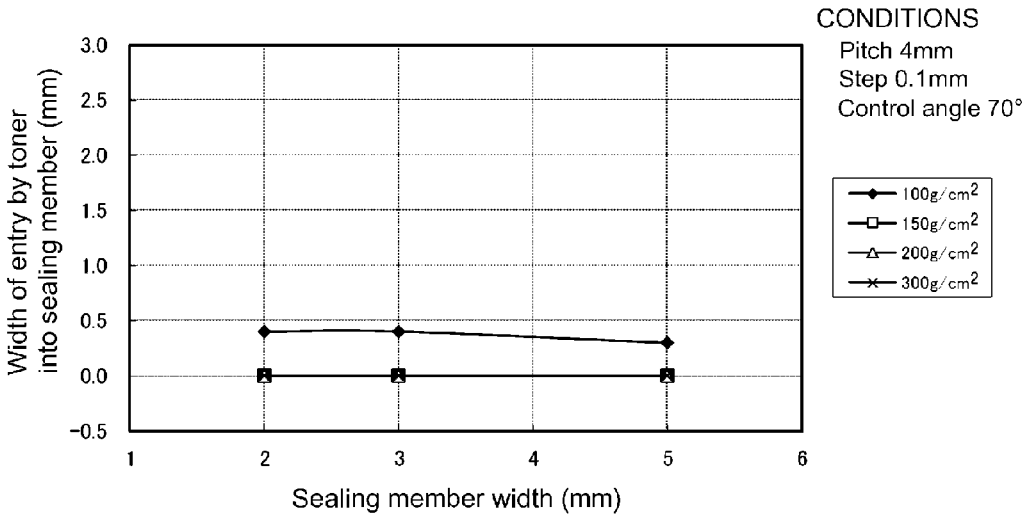
FIG. 22 Graph showing relationship between width of sealing member and width of entry of toner.

Using sealing members 1*a* having steps comprising woven fabric 1*c* at which toner control angle 10 was 70°, foamed polyurethane elastic body 11 was applied to the back surfaces to form sealing members 1*a* of different widths, and the width to which toner 7 had entered the sealing members 1*a* was measured in an actual production machine, results being shown in FIG. 22. As shown in FIG. 22, as a result of measurements carried out when the width of the sealing member 1*a* was varied between 2 mm and 5 mm, it was found that the width to which toner 7 had entered was 2 mm, indicating adequate seal function.

Foamed polyurethane constituting elastic body 11 was applied to the back surface of sealing member 1*a* comprising molded resin body 9*b* having stripes comprising steps, two-sided adhesive tape if was moreover applied to the back surface of the foamed polyurethane, and toner control angle 10 was thereafter made to be 70° to fabricate end seal member 1, results of testing carried out in an actual production machine being shown in TABLE 1. As indicated at TABLE 1, Seal characteristics were no good as indicated by x at Comparative Example 1 and 2, in which radius region 3 at scraping angle 8 were 156 μm and 92 μm and Toner scraping angle 16° and 20°, and Seal characteristics were no good Seal characteristics were okay or good as indicated by Δ or ○ at Working Example 1 and 2, in which radius region 3 at scraping angle 8 were 62 μm and 48 μm and Toner scraping angle were 25° and 28°. Note that this testing in an actual production machine of sealing member 1*a* comprising molded resin body 9*b* having steps was carried out with a surface velocity of 250 mm/s at toner carrier 6.

TABLE 1

| | Control angle (°) | Recess width (mm) | Recess thickness (mm) | Scraping angle radius R (μm) | Step (mm) | Contact load (g) | Toner scraping angle (°) | Toner angle of repose (°) | Seal characteristics |
|---|---|---|---|---|---|---|---|---|---|
| Comparative Example 1 | 70 | 2 | 0.2 | 156 | 0.05 | 391 | 16 | 27 | X (no good) |
| Comparative Example 2 | 70 | 2 | 0.15 | 94 | 0.1 | 385 | 20 | 27 | X (no good) |
| Working Example 1 | 70 | 2 | 0.10 | 62 | 0.15 | 414 | 25 | 27 | Δ (okay) |
| Working Example 2 | 70 | 2 | 0.05 | 48 | 0.2 | 378 | 28 | 27 | ○ (good) |

Foamed polyurethane constituting elastic body 11 was applied to the back surface of sealing member 1*a* comprising woven fabric 1*c* having stripes comprising steps, two-sided adhesive tape if was moreover applied to the back surface of the foamed polyurethane, and toner control angle 10 was thereafter made to be 70° to fabricate end seal member 1, results of testing carried out in an actual production machine being shown in TABLE 2. As indicated at TABLE 2, results indicated no problem with seal characteristics, with no dependency being exhibited with respect to thickness of the yarn from which the woven fabric 1*c* was formed. That is, at Working Examples 4 through 10, in which fiber diameter at warp yarn 1*i* constituting Toner scraping angle was 19 μm to 21 μm, this being less than 0.1 mm, seal characteristics were good, there being no problem, as indicated by O. That is, fiber (filament) diameter being less than 0.1 mm, these results indicate that scraping by the filament is taking place at the location of warp yarn 1*i* which constitutes Toner scraping angle, and also that seal characteristics were good, there being no problem, as indicated by O, for toners 7 having different angles 7*a* of repose.

control angle 10, movement of toner 7 prevents leakage of toner 7 to the exterior of the device of toner carrier 6, and by causing recessed region 2*f* to have less than or equal to a prescribed gap 13 with toner carrier 6, the end seal member 1 is capable of adequately withstanding vibrations during transport of toner 7 and during use of toner carrier 6, making it possible to carry out sealing with a narrow seal width that was not possible conventionally. Accordingly, sealing member 1*a* is economical, and it is possible to achieve reduction in the size of the device.

Figure 23:
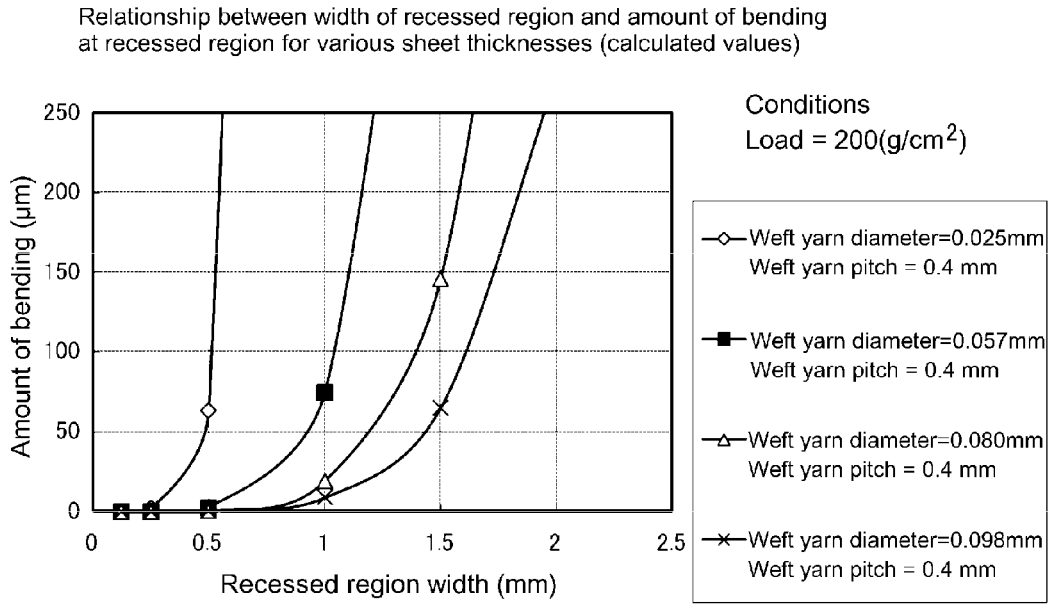
FIG. 23 Graph showing calculated relationship between recess width and amount of bending for several resin sheet thicknesses when under a prescribed load.

Furthermore, in accordance with the constitution of sealing member 1*a* of the present invention, it is possible to carry out fabrication such that there is any desired pitch width 2*i* and stripe width 2*g* at step(s). Furthermore, with respect to thickness 2*h* of recessed region 2*f*, while this depends somewhat on the width of recessed region 2*f*, FIG. 23 shows a drawing presenting results of theoretical calculations for a resin sheet constituting molded resin body 9*b*, bending and deformation being facilitated, and usage also being facilitated, when thickness 2*h* is less than or equal to 0.1 mm, less than or equal to 0.05 mm being preferred. In

TABLE 2

| | Control angle (°) | Recess width (mm) | Recess thickness (mm) ( ) indicates weft yarn diameter | Warp yarn 1i of which constituting scraping angle: Thickness of yarn | Fiber diameter (μm) | Step (mm) | Contact load (g) | Toner Scraping angle (°) | Evaluated toner angle of repose (°) | Seal characteristics |
|---|---|---|---|---|---|---|---|---|---|---|
| Working Example 4 | 70 | 2 | 0.17 (0.08) | 78T/24F | 19 | 0.1 | 150 | 58.6 | 27 | ○ (OK) |
| Working Example 5 | 70 | 1 | 0.17 (0.08) | 78T/24F | 19 | 0.1 | 150 | 58.6 | 27 | ○ (OK) |
| Working Example 6 | 70 | 0.5 | 0.17 (0.08) | 78T/24F | 19 | 0.1 | 150 | 58.6 | 27 | ○ (OK) |
| Working Example 7 | 70 | 2 | 0.17 (0.08) | 56T/17F | 19 | 0.05 | 150 | 58.6 | 27 | ○ (OK) |
| Working Example 8 | 70 | 2 | 0.17 (0.08) | 122T/30F | 21 | 0.15 | 150 | 56.2 | 27 | ○ (OK) |
| Working Example 9 | 70 | 2 | 0.17 (0.08) | 244T/60F | 21 | 0.2 | 150 | 56.2 | 27 | ○ (OK) |
| Working Example 10 | 70 | 2 | 0.17 (0.08) | 78T/24F | 19 | 0.1 | 150 | 58.6 | 38 | ○ (OK) |

Figure 24:
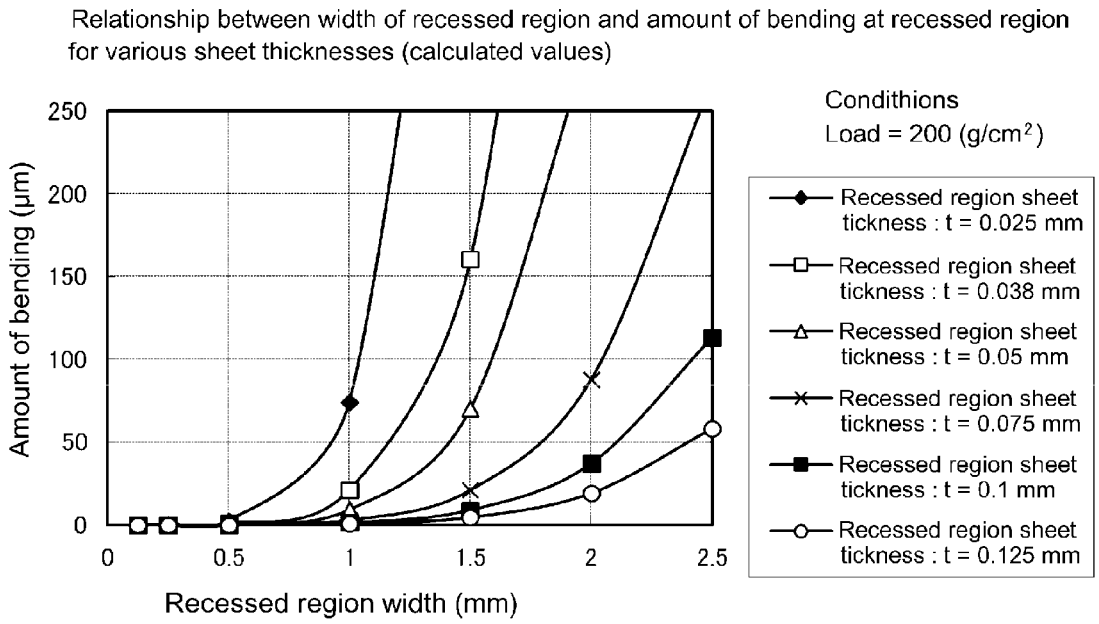
FIG. 24 Graph showing calculated relationship between recess width and amount of bending when weft yarn diameter is varied when under a prescribed load.

Based on the results at the foregoing TABLE 1 and TABLE 2, at end seal member 1 in image-forming device 5 using sealing member 1*a* having a plurality of steps, even where there is less than or equal to a prescribed gap 13 between recessed region 2*f* and the toner carrier and notwithstanding presence of a gap 15 at edge 2*e* of projecting region 2*d* of the step(s) which comprises recessed region 2*f* and projecting region 2*d*, the end seal member 1 is capable of functioning adequately as a seal with respect to toner 7, and due to rotation of toner carrier 6, there being a toner addition, FIG. 24 shows a drawing presenting results of theoretical calculations, and, during use of sealing member 1*a* made of woven fabric 1*c*, as the primary component governing bending and deformation is weft yarn 1*j*, it is also preferred that this weft yarn 1 be monofilament of diameter less than or equal to 100 μm, and based on usage of a filament diameter of around 25 μm which would be usable for woven fabric even at the width 2*m* at the recessed region, it is clear that a width greater than or equal to 0.25 mm will facilitate deformation, and will make it possible for the size of gap 13 between recessed region 2*f* of sealing member 1*a* and toner carrier 6 to be reduced as a result of contact pressure. Furthermore, because the end seal member 1 of the present invention is an end seal member 1 exhibiting improved effect with respect to scraping of toner 7 as a result of formation of a plurality of irregular surfaces 2*a* within end seal member 1 and because it is constituted so as to have toner control angle 10, it is necessary to set the maximum value for the width of recessed region 2*f* such that this is less than one-half of the width of end seal member 1.

Moreover, end seal member 1 for rotating body 6*a* constituting toner carrier 6 is capable of being used as an end seal member 1 for a photosensitive body or as an end seal member 1 for an intermediate belt. In addition, with respect to contamination due to adherence of toner 7 to seal regions as a result of dust-cloud-like expulsions of toner 7 during rotation of rotating body 6*a* constituting toner carrier 6, or contamination due to dust-cloud-like expulsions of toner 7 at locations at or exterior to ends of toner carrier 6 as a result of contact by recessed/projecting regions forming steps, rotation of rotating body 6*a* constituting toner carrier 6 makes it possible to cause movement of toner 7, permitting cleaning of end(s) 6*d* of surface(s) of rotating body 6*a* or end(s) of surface(s) of an intermediate belt. Note that where as described above woven fabric 1*c* is used as material for end seal member 1, as scraping is carried out by filament(s) constituting yarn at location(s) which form scraping angle 8, filament(s) constituting such yarn(s) may employ split fiber(s) comprising composite fiber(s) or may be of modified cross-section.

EXPLANATION OF REFERENCE NUMERALS

1 End seal member
1*a* Sealing member
1*c* Resin sheet having steps or woven fabric
1*d* Installation surface
1*e* Back surface
1*f* Two-sided adhesive tape
1*g* Adhesive layer
1*h* Seal member application region
1*i* Warp yarn
1*j* Weft yarn
1*k* Warp yarn
1*m* Satin weave
1*n* Plain weave
1*p* Twill weave
1*s* Seal member (sealing member+molded resin body+two-sided adhesive tape)
2*a* Irregular surface
2*c* Pattern of bands
2*d* Projecting region
2*e* Edge
2*f* Recessed region
2*g* Width
2*h* Thickness
2*i* Pitch width
2*j* Step height
2*k* Angle of inclination as measured from short side of stripe
2*m* Width of recessed region (as measured along long side of sealing member)
3 Radiused region
4 Chamfered region
5 (Electrophotographic) image-forming device
5*a* Toner handling device (developer apparatus)
5*b* Agitator (agitation member)
5*c* Supply roller
5*d* Control blade
6 Toner carrier
6*a* Rotating body
6*b* Outside diameter
6*c* Contacted surface
6*d* End
6*e* Direction of axis of rotation
6*f* Interior
7 Toner
7*a* Angle of repose
8 Scraping angle
8*a* Radiused region
9 Material (which forms radiused region)
9*a* Filament(s)
9*b* Molded resin body
10 Toner control angle (i.e., return angle)
11 Elastic body
11*a* Elastic layer
12 Contact region (between recessed region and toner carrier)
13 Gap (between recessed region and toner carrier)
14 Gap (allowing toner to be conveyed by toner carrier)
15 Gap (for which leakage does not occur at a desired acceleration)
16 Funnel
17 Vibration source
18 Toner box
19 Cover
20 Angle bar
21 Sensor
22 Direction of vibration
r Radius of radiused region
$r_1$ Radius of rotating body
$\phi_2$ Diameter of toner

The invention claimed is:

1. An end seal unit for an electrophotographic image-forming device comprising:

a sealing member having a first pattern of stripes of recessed region and projecting region, the projecting region having a chamfered or rounded edge, the recessed region and the projecting region comprising thereon a second pattern which is linearly extending, the second pattern including a plurality of steps which contact with a contacted surface of a rotating body constituting a toner carrier, a width of each of the recesses being from 0.25 mm to less than one-half of an end seal width, an elastic body attached at a back surface of the sealing member, and an installation seat where the sealing member with the elastic body is installed, wherein, when a toner particle of an average particle conveyed by the toner carrier comes in contact with the chamfered or rounded edge of the projecting region, a toner scraping angle defined by the chamfered or rounded edge which comes in contact with the toner particle, and a radius of a toner carrier is greater than an angle of repose of toner, and the first pattern comprising a plurality of steps has a toner control angle which causes toner to be returned inward in a direction of a rotational axis of a toner carrier as a result of rotation of a rotating body constituting a toner carrier, and when the sealing member contacts a rotating body the recessed region deforms toward a rotating body so as to contact a rotating body, or so as to form a gap between the recessed region and a rotating body, the gap permitting transfer of the toner scraped by a rotating body but prevent the toner from leaking at an acceleration less than or equal to 40 $m/s^2$, wherein a maximum radius at the rounded edge at a projecting region constituting said scraping angle is 0.1 mm, and a material from which a rounded edge is formed comprises a molded resin body or yarn comprising filament.

2. An end seal unit for an electrophotographic image-forming device according to claim 1, wherein prevention of leakage of toner from an end of a toner carrier is determined the steps of the second pattern relative to an outside diameter of a rotating body constituting a toner carrier, an edge at a projecting region, a width of a recessed region, a thickness of a recessed region, a material of a sealing member, a control angle of stripes of the recessed region and projecting region relative to a rotating body constituting a toner carrier, and a contact load; and a gap for transfer of toner formed at a corner of a recessed region as a result of contact of a toner carrier and a recessed region, or a gap which is a maximum of 100 μm at a recessed region and a rotating body constituting a toner carrier.

3. An end seal unit for an electrophotographic image-forming device according to claim 1 wherein the sealing member is formed of a material chosen from resin sheet comprising a molded resin body or striped woven fabric having steps comprising weave patterns of two types and using at least two or more yarns which are yarns comprising filaments which are continuous fibers, an integral seal member being obtained from this sealing member and a molded resin body constituting an elastic body which is provided at a back surface of this sealing member, a toner control angle which is an angle causing toner to be returned toward an interior in a direction of a rotational axis of a toner carrier as a result of a direction of rotation of a rotating body constituting a toner carrier is formed when this seal member sheet material is cut into a desired end seal shape.

4. An end seal unit for an electrophotographic image-forming device according to claim 1, wherein the end seal unit is used in at least one of a cleaning container or a develop container, and the end seal unit prevents leakage of toner from cleaning container for recovered toner by means of a cleaning blade at an electrophotographic image-forming device or the end seal member prevents leakage of toner from a develop container having a develop roller at an image-forming device.

5. An end seal unit for an electrophotographic image-forming device according to claim 2, wherein the end seal member used in at least one of a cleaning container or a develop container, and the end seal member prevents leakage of toner from cleaning container for recovered toner by means of a cleaning blade at an electrophotographic image-forming device or an end seal member that prevents leakage of toner from a develop container having a develop roller at an image-forming device.

6. An end seal unit for an electrophotographic image-forming device according to claim 3, wherein the end seal member used in at least one of a cleaning container or a develop container, and the end seal member prevents leakage of toner from cleaning container for recovered toner by means of a cleaning blade at an electrophotographic image-forming device or an end seal member that prevents leakage of toner from a develop container having a develop roller at an image-forming device.

7. An end seal unit for an electrophotographic image-forming device comprising:

a sealing member having a first pattern of stripes of recessed region and projecting region, the projecting region having a chamfered or rounded edge, the recessed region and the projecting region comprising thereon a second pattern which is linearly extending, the second pattern including a plurality of steps which contact with a contacted surface of a rotating body constituting a toner carrier, a width of each of the recesses being from 0.25 mm to less than one-half of an end seal width, an elastic body attached at a back surface of the sealing member, and an installation seat where the sealing member with the elastic body is installed, wherein, when a toner particle of an average particle conveyed by the toner carrier comes in contact with the chamfered or rounded edge of the projecting region, a toner scraping angle defined by the chamfered or rounded edge which comes in contact with the toner particle, and a radius of a toner carrier is greater than an angle of repose of toner, and the first pattern comprising a plurality of steps has a toner control angle which causes toner to be returned inward in a direction of a rotational axis of a toner carrier as a result of rotation of a rotating body constituting a toner carrier, and when the sealing member contacts a rotating body the recessed region deforms toward a rotating body so as to contact a rotating body, or so as to form a gap between the recessed region and a rotating body, the gap permitting transfer of the toner scraped by a rotating body but prevent the toner from leaking at an acceleration less than or equal to 40 $m/s^2$, wherein the end seal unit is used in at least one of a cleaning container or a develop container, and the end seal unit prevents leakage of toner from the cleaning container for recovered toner by means of a cleaning blade at an electrophotographic image-forming device or an end seal member prevents leakage of toner from a develop container having a develop roller at an image-forming device.

* * * * *